United States Patent [19]

Gill et al.

[11] 4,138,312

[45] Feb. 6, 1979

[54] PROCESS OF RECOVERING SODIUM CARBONATE FROM SPENT PULPING LIQUORS

[75] Inventors: Ronald A. Gill, Johannesburg; Waldemar S. Wojtowicz, Krugersdorp, both of South Africa; Cornelius E. Berthold, Littleton, Colo.; Cecil M. Wheeler, Oak Brook, Ill.

[73] Assignee: Sappi Limited, Johannesburg, South Africa

[21] Appl. No.: 797,563

[22] Filed: May 16, 1977

[30] Foreign Application Priority Data

May 19, 1976 [ZA] South Africa ..... 76/2995

[51] Int. Cl.[2] ..... D21C 11/04

[52] U.S. Cl. ..... 162/30 R; 162/33

[58] Field of Search ..... 162/30 R, DIG. 8, 33; 423/182, 183, 184, 186, 189, 190, 207, 208, 421, 422, 425, 427, DIG. 3

[56] References Cited

U.S. PATENT DOCUMENTS

| | | | |
|---|---|---|---|
| 1,906,886 | 5/1933 | Richter | 162/30 R |
| 2,120,287 | 6/1938 | MacMullin | 423/427 |
| 2,842,489 | 7/1958 | Svanoe | 423/425 |
| 3,347,739 | 10/1967 | Tomlinson | 162/30 R |
| 3,367,735 | 2/1968 | Hanway et al. | 423/189 |
| 3,909,344 | 9/1975 | Lukes | 162/30 R |
| 3,954,552 | 5/1976 | Lukes et al. | 162/DIG. 8 |

FOREIGN PATENT DOCUMENTS

| | | | |
|---|---|---|---|
| 928008 | 6/1973 | Canada | 162/DIG. 8 |
| 2159935 | 6/1973 | France | 162/DIG. 8 |

*Primary Examiner*—S. Leon Bashore
*Assistant Examiner*—Peter F. Kratz
*Attorney, Agent, or Firm*—Merriam, Marshall & Bicknell

[57] ABSTRACT

The incinerator product obtained from the incineration of black liquor and other spent liquors from a soda pulping process is treated to remove contaminants including chlorides, sulphates and potassium compounds and to recover a high proportion of the sodium carbonate. The incinerator product is treated with water to form a slurry in which substantially pure sodium carbonate monohydrate is crystallized and a major proportion of the contaminants are dissolved, the sodium carbonate monohydrate is then separated and dissolved sodium carbonate is recovered as a bicarbonate or sesquicarbonate precipitate by carbonation of the solution. The preferred process involves an initial flue gas carbonation of the separated mother liquor after removal of sodium carbonate monohydrate to produce a sodium sesquicarbonate precipitate and a subsequent carbonation of the mother liquor, after separation of the sodium sesquicarbonate therefrom, with pure carbon dioxide to precipitate sodium bicarbonate.

9 Claims, 1 Drawing Figure

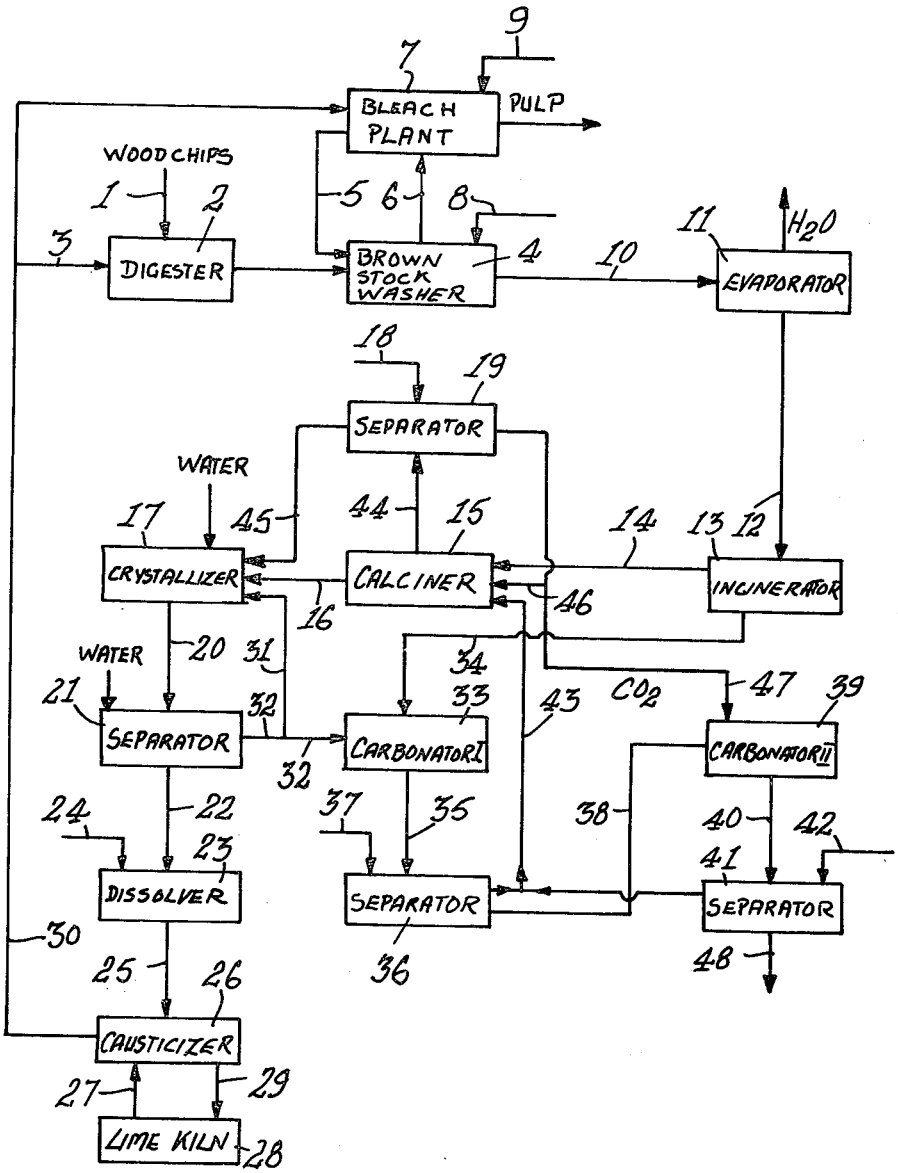
BLEACH PLANT
PULP
WOOD CHIPS
DIGESTER
BROWN STOCK WASHER
EVAPORATOR
$H_2O$
SEPARATOR
WATER
CRYSTALLIZER
CALCINER
INCINERATOR
WATER
SEPARATOR
CARBONATOR I
$CO_2$
CARBONATOR II
DISSOLVER
SEPARATOR
SEPARATOR
CAUSTICIZER
LIME KILN

PROCESS OF RECOVERING SODIUM CARBONATE FROM SPENT PULPING LIQUORS

FIELD OF THE INVENTION

This invention relates to a process for the recovery of chemicals employed in soda and/or oxygen pulping of cellulosic vegetable matter and/or oxygen bleaching-/delignification of the resulting pulp, such processes which use sodium hydroxide or sodium carbonate as the pulping or bleaching chemical hereinafter being called "soda processes". More particularly the invention is concerned with the removal of contaminants from fluidised bed incinerator recovered products derived from chemical recovery systems employed in soda processes. Such contaminants include chlorides, sulphates and potassium compounds.

BACKGROUND OF THE INVENTION

In sodium based pulp mills the black liquor containing spent chemicals from the digestion of cellulosic vegetable fibres and in some cases the spent liquor from an oxygen bleaching/delignification stage is passed to a chemical recovery system where the black liquor is first reduced in volume by evaporation. Thereafter the concentrated material is incinerated, for example, in a furnace or by means of a fluidised bed reactor. Finally the incinerator product, which in soda processes contains a high percentage of sodium carbonate, is dissolved in water and causticised to convert the sodium carbonate to sodium hydroxide and the "white liquor" so obtained is returned for re-use in the digestion process.

Although soda processes exclude the use of sulphur containing chemicals for the digestion of wood and while oxygen bleaching of the pulp excludes the use of chlorine, both of these contaminants may be introduced into the process as constituents of the raw materials and process water used. Potassium compounds are also contained in wood and of course where sea water floated logs are concerned substantial quantities of chlorides are introduced into the process. In a closed pulping and recovery circuit, a build-up of contaminants such as chlorides, sulphates and potassium compounds may therefore occur.

When a fluidised bed reactor is used to incinerate concentrated liquor containing these contaminants, loss of fluidisation of the reactor bed will occur if the concentration of the contaminants exceeds a critical level.

DESCRIPTION OF THE PRIOR ART

Prior work has been carried out in order to remove chloride contaminants from furnace smelts. For example U.S. Pat. No. 3,909,344 describes a process of leaching and/or crystallisation of the furnace smelt for the recovery of sodium carbonate and the removal of sodium chloride by precipitation of sodium chloride from the mother liquor from the crystallisation stage. However this process makes no provision for removal of other contaminants such as sulphates and potassium compounds, a build up of which is unacceptable in a fluidised bed reactor operating on a soda recovery process.

Canadian Pat. No. 928,008 likewise describes a process for the removal of chlorides from furnace smelts by leaching and crystallisation procedures but this process also centres around the crystallisation of sodium chloride in order to remove this contaminant from the circuit. No provision is made however for removing sulphate and potassium compounds when the patent is applied to a sulphur free soda process.

A further patent concerned with the recovery of pulping chemicals from spent digester liquors, namely, U.S. Pat. No. 1,906,886 (Richter), describes a process for the crystallisation of sodium carbonate from smelt liquors in order to recover a portion of the sodium carbonate from a furnace smelt product. This patent, however, is not concerned with the removal of contaminants but rather with the removal of some sodium carbonate for use as a raw material in another process and only the balance of the chemicals is capable of re-use in the original pulp making operation from which the spent cooking liquor arose. Thus the Richter process will usually involve separation of the recovered components for use in different though simultaneous pulping operations and Richter is not, therefore, concerned with a single closed circuit in which the recovered chemicals are re-used in the same pulping process. Contaminants are not removed in accordance with the Richter process and, although substantially pure sodium carbonate is recovered by the crystallisation or carbonation, too small a proportion of the sodium carbonate is recovered in order effectively to operate a closed circuit recovery system.

Our co-pending application No. 727,579 describes a process for removing chlorides, sulphates and potassium compounds, from an incinerator product. This process consists of leaching the incinerator product with water to dissolve contaminants together with a portion of the sodium carbonate leaving the bulk of the sodium carbonate in solid form and substantially more pure and recovering sodium carbonate from the solution by subjecting the solution to carbonation thus precipitating sodium bicarbonate and sodium sesquicarbonate. In the preferred method of our co-pending application a sodium carbonate decahydrate crystallisation step is carried out on the solution after the leaching step and prior to the carbonation step. The method described results in the removal of contaminants to a high degree making it possible to utilise a fluidised bed incinerator in a closed chemicals recovery system.

SUMMARY OF THE INVENTION

It is an object of the present invention to provide an alternative and more efficient process for the removal of chlorides, sulphates and potassium compounds from a sodium carbonate incinerator product.

According to the invention in a process for the manufacture of cellulose pulp by means of a soda process in which spent liquors are concentrated by evaporation and the concentrated liquors are incinerated in a fluidised bed incinerator to produce a granular sodium carbonate incinerator product contaminated by chlorides, sulphates and potassium compounds, the incinerator product being dissolved in water and causticised in known manner to form white liquor comprising essentially sodium hydroxide, which white liquor is re-used in the said soda process to provide a closed system, the improvement comprising treating the incinerator product with water to form a slurry, agitating the slurry so as to dissolve incinerator product with its contaminants and at the same time crystallise substantially pure sodium carbonate monohydrate leaving a major proportion of the contaminants in solution, separating the substantially pure sodium carbonate from the liquor containing the contaminants, converting sodium carbonate in solution to sodium bicarbonate by carbonation with carbon dioxide, separating the precipitate so formed from the mother liquor, converting the precipitate thus recovered to substantially pure sodium carbonate, utilising the various fractions of sodium carbonate recovered for the formation of the said white liquor, and discharging the contaminant bearing mother liquor from the system.

Such separation may be accomplished by filtration or by means of a centrifuge or by permitting the solids to settle and decanting off the supernatant liquor or by any other suitable means. Formation of the slurry may be effected in a crystallisation vessel equipped with a stirrer or any other suitable means for agitating the slurry.

The spent liquors derived from a soda process include those emanating from a soda cooking stage as well as an oxygen bleaching or delignification stage carried out in the presence of sodium hydroxide or sodium carbonate and these liquors may be treated separately or in combination.

The temperature of the slurry should be kept above 35° C., and preferably at 85° C. The incinerator product should be added in pelletised or ground form and preferably such product is at a temperature exceeding 260° C. when introduced into the crystallisation vessel.

After separation of the solids from the slurry a portion of the separated liquor should be recycled back to the crystalliser for the formation of slurry with incoming incinerator product, the solution of further contaminants and the precipitation of sodium carbonate monohydrate. The portion of separated liquor not recycled is discharged to maintain a balance between the mass of contaminants introduced with the incinerator product and the mass of contaminants discharged with said liquor. Enough water should be added to the system to make up for losses, for example, through hydration of sodium carbonate, evaporation, entrainment of liquor in the solids and discharge of a portion of the liquor as described above. This water is optionally introduced into the system as wash water for the solids separated from the system.

The invention also provides for carbonating the mother liquor with a flue gas containing carbon dioxide, maintaining the liquor at a temperature of about 45° C., thereby producing a precipitate containing sodium sesquicarbonate and separating the precipitate from the mother liquor.

It has been found that nearly half of the sodium carbonate in solution resulting from the sodium carbonate monohydrate crystallisation step can be precipitated as sodium sesquicarbonate ($Na_2CO_3$. $NaHCO_3.2H_2O$) by sparging with flue gas. This process has the advantage over our aforementioned co-pending application that the solution need not be cooled below 30° C. to precipitate the decahydrate of sodium carbonate and that pure carbon dioxide gas need not be used in the carbonation process to precipitate sodium bicarbonate as the only compound recovered.

Further sodium carbonate can be recovered by carbonating the mother liquor, after separation of the sodium sesquicarbonate, with substantially pure carbon dioxide, maintaining the temperature of the liquor at about 45° C., precipitating sodium bicarbonate and separating the precipitate from the solution. Sodium carbonate which dissolves in the monohydrate crystallisation process is thus recovered by using the abovementioned processes in series. The crystals of sodium sesquicarbonate and sodium bicarbonate produced in the carbonation stages are separated from their mother liquors by settling or filtration or centrifugal separation and the mother liquors containing the bulk of the contaminants are discharged from the system.

Although it might be possible to obtain sodium sesquicarbonate and sodium bicarbonate crystals of acceptable purity by merely separating the solid crystals from the solutions in the various stages, it is to be noted that these solutions contain large proportions of the dissolved contaminants and that crystals may occlude some of this solution. It is therefore desirable to wash the separated crystals in the filtration or centrifuging processes.

The recovered sodium carbonate monohydrate with contaminants at an acceptable level can be dissolved to produce "green liquor" which is processed further according to known procedures to produce the "white liquor" used for example for soda pulping, oxygen pulping, oxygen bleaching or any bleaching stage requiring caustic soda.

Similarly the crystals of sodium sesquicarbonate and sodium bicarbonate may be dissolved and causticised to product white liquor. However, with the sesquicarbonate and bicarbonate mixture the causticising would consume more lime than normally required because the sodium bicarbonate has to be converted to sodium carbonate by the lime before the normal causticising reaction can take place.

Preferably therefore the mixture of sodium sesquicarbonate and sodium bicarbonate crystals are first decomposed by heating to convert the mixture to sodium carbonate, water and carbon dioxide. This carbon dioxide can be recovered and re-used for carbonation in the final bicarbonate precipitation stage described above. The decomposition can be carried out in solution or the crystals can be decomposed in a kiln or fluidised bed according to known processes. The sodium carbonate can then be dissolved together with the monohydrate crystals to produce "green liquor" and the latter processed to form "white liquor" for use in pulping or bleaching of vegetable fibres.

BRIEF DESCRIPTION OF THE DRAWING

The accompanying drawing is a schematic flow sheet of a soda pulping process embodying a pulping chemical recovery circuit according to the invention.

DETAILED DESCRIPTION OF THE DRAWING

Referring to the drawing, wood chips are fed by line 1 to a digester 2, wherein the wood chips are digested by a pulping liquor fed by line 3 and containing sodium hydroxide as the active pulping chemical in the soda process.

The resulting pulp and spent pulping liquor are separated and the pulp is washed with water 8, on brown stock washer 4. The pulp can be washed with oxygen bleach plant effluent fed by the line 5 if desired.

The washed, unbleached pulp is fed by line 6 to an oxygen bleaching plant 7 and the bleached pulp is washed by water fed by line 9.

The spent liquor 10 which may also contain substances derived from the bleaching operation is evaporated in an evaporator 11.

The concentrated spent liquor 12 is burnt in a fluidised bed incinerator 13, and the hot granular incinerator product proceeds by line 14 to a calciner 15. The incinerator product consists mainly of sodium carbonate containing contaminants such as chlorides, sulphates and potassium compounds. The incinerator product after passing through the calciner goes by line 16 to the crystalliser 17, together with sodium carbonate produced in the calciner by decomposition of sesquicarbonate and bicarbonate crystals delivered to the calciner 15 by line 43. In the crystalliser the incinerator product is slurried in a solution containing dissolved incinerator product. The temperature of the slurry is maintained above 35° C., and sodium carbonate monohydrate is crystallised. The contaminants dissolve and remain in solution. The slurry containing newly formed sodium carbonate monohydrate is withdrawn from the crystalliser by line 20, to the separator 21. The solids so separated after washing with water contain substantially pure sodium carbonate and proceed by line 22 to the dissolver 23. The separated solution containing the bulk of the contaminants and dissolved sodium carbonate is recycled by line 31 to the crystalliser with a bleed off by line 32 to the carbonator 33. The volume of solution in the crystalliser is kept constant by adding make-up water by line 18 to separator 19 or by adding it directly to the crystalliser.

The separated solids are dissolved in dissolver 23 with water or preferably weak white liquor delivered by line 24 to the dissolver. The solution called green liquor proceeds by line 25 to the causticiser 26, where sodium carbonate is converted substantially completely to sodium hydroxide by reaction with lime 27 from lime kiln 28. The precipitated calcium carbonate mud in the causticiser 26 is separated from the sodium hydroxide solution known as strong white liquor and is washed with water to remove entrained alkali from it. The resulting wash solution is called weak white liquor and should preferably be used to dissolve the sodium carbonate in dissolver 23.

After washing, the calcium carbonate mud may be returned by line 29 to a lime kiln 28 to be converted to calcium oxide.

The strong white liquor obtained from causticiser 26 is recycled via line 30 to provide the pulping liquor fed by line 3 to digester 2. This sodium hydroxide solution can also be used as a source of alkali in the bleach plant 7.

In the carbonator 33, the solution introduced via line 32 is subjected to the carbonation process by reaction with carbon dioxide contained in the flue gas from incinerator 13 delivered by line 34. This flue gas should first be cooled as the temperature in the carbonator should be below 60° C. In the reaction with carbon dioxide carbonate in solution is converted to bicarbonate and precipitates mainly as sodium sesquicarbonate.

The slurry so formed proceeds by line 35 to a separator 36. The solid sodium sesquicarbonate is separated from the solution and may be washed with water 37 if desired. The solution from the separator 36 proceeds by line 38 for the second carbonation stage in carbonator 39 where it is subjected to the carbonation process by reaction with concentrated carbon dioxide gas delivered by line 47. The carbonate in solution is converted to bicarbonate and precipitates mainly as sodium bicarbonate.

The slurry so formed is delivered by line 40 to a separator 41 where the solids are separated from the solution and may be washed if desired by water 42.

The solids from the separators 36 and 41 proceed by line 43 to the calciner 15 where the heat contained in the incinerator product calcines them to sodium carbonate, carbon dioxide and water.

The carbon dioxide gas with water vapour and some entrained solids from the calciner 15, proceeds by line 44 to the separator 19, where solids are removed by scrubbing with water 18 and returned by line 45 to the crystalliser 17.

The gas containing carbon dioxide and water vapours is passed to the second stage carbonator by line 47, with a portion of the gas being recycled by line 46 to the calciner.

Liquor 48 from the separator 41, containing substantially all the contaminants in solution is discharged from the system.

In order to illustrate the invention examples thereof will now be described.

EXAMPLE 1

4.5 liters of a liquor (L.S.) containing the constituents given in the analysis of liquor (L.S.) below was placed in an agitated vessel and heated to a temperature of 85° C. A series of crystallisations were carried out by adding an incinerator product (S.S.) derived from a soda cooking process to the liquor in the vessel in the following manner. For the first crystallisation, 840g of the incinerator product (S.S.) at a temperature of 320° C. was added to the liquor in the vessel and the slurry so formed was agitated for a period in excess of 15 minutes maintaining the temperature of the slurry at 85° C. At the end of this period 2 liters of slurry were withdrawn from the vessel, filtered under vacuum and the separated solids washed with 400 ml of hot water. The washed solids (S.C.l.) were analysed. The liquor (L.C.l.) separated prior to washing, was analysed and returned to the agitated vessel. The washings were also returned to the vessel.

Prior to the second crystallisation, the volume of slurry in the agitated vessel was made up to 4.5 liters with water and the temperature of the slurry adjusted to 85° C.

For the second crystallisation, 840g of incinerator product (S.S.) at a temperature of 320° C. was added to the slurry in the vessel and the slurry was agitated for a period in excess of 15 minutes, maintaining the temperature of the slurry at 85° C. At the end of this period, 2 liters of slurry were withdrawn from the vessel filtered under vacuum and the separated solids washed with 400 ml of hot water. The washed solids were analysed. The liquor separated prior to washing was analysed and returned to the agitated vessel. The washings were returned to the vessel.

Prior to the third crystallisation the volume of slurry in the agitated vessel was made up to 4.5 liters with water and the temperature of the slurry adjusted to 85° C.

A total of eight crystallisations were carried out in the manner described for the second crystallisation recycling the separated liquors and the washings to the agitated vessel and making up the volume of slurry to 4.5 liters with water prior to each subsequent crystallisation.

The analysis of the following products produced in this example are given below:

| | |
|---|---|
| Incinerator product | (S.S.) |
| Starting liquor | (L.S.) |
| Solids separated after first crystallisation | (S.C.1) |
| Liquor separated after first crystallisation | (L.C.1) |
| Solids separated after eight crystallisations | (S.C.8) |
| Liquor separated after eighth crystallisation | (L.C.8) |

| S.S. | L.S. | S.C.1 | L.C.1 | S.C.8 | L.C.8 |
|---|---|---|---|---|---|

-continued

| | | | | | | | |
|---|---|---|---|---|---|---|---|
| Sodium as Na | % | 40.1 | 13.8 | 33.0 | 13.9 | 32.7 | 10.9 |
| Potassium as K | % | 1.58 | 1.91 | 0.03 | 2.18 | 0.06 | 3.03 |
| Carbonate as $CO_3$ | % | 51.2 | 15.4 | 42.7 | 14.9 | 41.4 | 13.8 |
| Sulphate as $SO_4$ | % | 4.8 | 4.5 | 0.88 | 6.0 | 2.0 | 6.7 |
| Chloride as Cl | % | 0.48 | 0.51 | 0.004 | 0.70 | 0.011 | 1.2 |
| Water | % | 1.8 | 63.9 | 23.4 | 62.5 | 22.0 | 64.3 |

NOTE

No bleed out of liquor was carried oyt between each crystallisation (except for material consumed in analysis) as it was deemed that the liquors were not sufficiently concentrated in contaminants. It will be noted that the concentration of contaminants increased between the first and the eighth crystallisation. To maintain the concentration of any one contaminant in liquor L.C.8 for further crystallisations, it would be necessary to bleed out liquor in sufficient volume to maintain a balance between the mass of such contaminant entering the vessel and the mass of such contaminant leaving in the solids and in the bleed out. For example, further buildup in the concentration of chloride in the liquor could be prevented as follows:

| | |
|---|---|
| Chlorides entering in 840g of incinerator product at 0.48% | = 4.03g |
| Chlorides removed in the solids at 0.011% (1 060g of solids from 2 liters of slurry in the 8th crystallisation) | = 0.12g |
| Hence Chlorides to be removed in the bleed out | = 3.91g |

At a concentration of 1.2% chloride in the liquor, 325.8g of liquor would be bled out prior to the 9th crystallisation.

EXAMPLE 2

A liquor representing the liquor composition after repeated crystallisations with the same liquor was prepared for use in pilot plant experiments in order to precipitate sodium sesquicarbonate from it. The liquor was kept in a carbonating column at 43° C. and was sparged with a mixture of air and carbon dioxide containing 14% carbon dioxide by volume. Sparging was continued for 16 hours whilst maintaining the temperature at 43° C. Thereafter fresh liquor was added periodically and slurry was withdrawn at such a rate as to replace the contents of the column in 15 hours. At the end of this period the slurry was withdrawn from the column and the crystals were separated from the liquor in a continuous centrifuge. The liquor before and after carbonation was analysed as well as the crystals. The results were the following:

| | Liquor before Carbonation | Liquor after Carbonation | Crystals |
|---|---|---|---|
| Sodium as Na | 11.40% | 8.48% | 27.08% |
| Potassium as K | 2.36% | 2.37% | 0.34% |
| Carbonate as $CO_3$ | 14.49% | 8.41% | 26.50% |
| Bicarbonate as $HCO_3$ | nil | 1.42% | 18.60% |
| Sulphate as $SO_4$ | 5.14% | 5.75% | 0.38% |
| Chloride as Cl | 1.23% | 1.43% | 0.17% |
| Water | 65.38% | 71.64% | 26.93% |

The liquor remaining after separation of the sodium sesquicarbonate crystals was carbonated with pure carbon dioxide to precipitate sodium bicarbonate. This is described in the next example.

EXAMPLE 3

After the sodium sesquicarbonate crystals had been removed from it, the liquor was returned to the carbonating column, the temperature was kept at 49° C. and the solution was sparged with pure carbon dioxide for 11 hours. Thereafter fresh liquor was added periodically and slurry removed at such a rate as to replace the contents of the column in 15 hours. The crystals were then separated from the liquor in a continuous centrifuge. The liquor at the beginning and end of the carbonation process was analysed as well as the crystals. The following results were obtained:

| | Liquor before Carbonation | Liquor after Carbonation | Crystals |
|---|---|---|---|
| Sodium as Na | 8.48% | 4.16% | 20.04% |
| Potassium as K | 3.03% | 3.18% | 0.65% |
| Carbonate as $CO_3$ | 9.10% | 0.90% | 3.50% |
| Bicarbonate as $HCO_3$ | 0.96% | 5.40% | 54.50% |
| Sulphate as $SO_4$ | 6.00% | 7.23% | 1.25% |
| Chloride as Cl | 1.16% | 1.41% | 0.24% |
| Water | 71.27% | 77.72% | 19.82% |

Whereas the above examples relate to a batch process, it will be appreciated that the process of the invention may be operated batch-wise or on a continuous basis.

We claim:

1. A process for the manufacture of cellulose pulp by means of a soda process in which spent liquors are concentrated by evaporation and the concentrated liquors are incinerated in a fluidized bed incinerator to produce a granular sodium carbonate incinerator product contaminated by chlorides, sulphates and potassium compounds, the incinerator product being dissolved in water and causticized in known manner to form white liquor comprising essentially sodium hydroxide, which white liquor is re-used in the said soda process to provide a closed system, the improvement comprising:

treating the incinerator product with water to form a slurry, agitating the slurry so as to dissolve incinerator product with its contaminants and at the same time crystallize substantially pure sodium carbonate monohydrate leaving a major proportion of the contaminants in solution, separating the substantially pure sodium carbonate from the liquor containing the contaminants, and washing the separated sodium carbonate with water;

converting sodium carbonate remaining with the contaminants in solution to sodium bicarbonate by carbonation with carbon dioxide, separating the precipitate so formed from the mother liquor, and converting the precipitate thus recovered to substantially pure sodium carbonate;

utilizing sodium carbonate recovered in the formation of white liquor; and discharging the contaminant bearing mother liquor from the system.

2. The process of claim 1 in which the temperature of the slurry is maintained above 35° C.

3. The process of claim 2 in which the temperature of the slurry is maintained at approximately 85° C.

4. The process of claim 1 in which a portion of the liquor obtained after separation of sodium carbonate from the slurry is recycled for the formation of slurry with incoming incinerator product, the solution of further contaminants and the precipitation of sodium carbonate monohydrate.

5. The process of claim 4 in which the portion of separated liquor not recycled is discharged, after carbonation with carbon dioxide, to maintain a balance between the mass of contaminants introduced with the incinerator product and the mass of contaminants discharged with said liquor.

6. The process of claim 5 in which make-up water is added to the slurry to replace losses of water, such make-up water being used for washing of sodium carbonate after separation from the liquor.

7. A process for the manufacture of cellulose pulp by means of a soda process in which spent liquors are concentrated by evaporation and the concentrated liquors are incincerated in a fluidized bed incinerator to produce a granular sodium carbonate incinerator product contaminated by chlorides, sulphates and potassium compounds, the incinerator product being dissolved in water and causticized in known manner to form white liquor comprising essentially sodium hydroxide, which white liquor is re-used in the said soda process to provide a closed system, the improvement comprising:

treating the incinerator product with water to form a slurry, agitating the slurry so as to dissolve incinerator product with its contaminants and at the same time crystallize substantially pure sodium carbonate monohydrate leaving a major proportion of the contaminants in solution, separating the substantially pure sodium carbonate from the first mother liquor containing the contaminants, and washing the separated sodium carbonate with water;

carbonating the first mother liquor with a flue gas containing carbon dioxide, maintaining the liquor at a temperature of about 45° C. producing a precipitate consisting mainly of sodium sesquicarbonate, separating the precipitate from the resulting second mother liquor, and converting the precipitate to substantially pure sodium carbonate;

converting sodium carbonate in the second mother liquor to sodium bicarbonate by carbonation with substantially pure carbon dioxide, separating the sodium bicarbonate precipitate so formed from the mother liquor, and converting the precipitate thus recovered to substantially pure sodium carbonate;

utilizing sodium carbonate recovered in the formation of white liquor; and discharging the contaminant bearing second mother liquor from the system.

8. The process of claim 7 in which the separated precipitates obtained after carbonation of the mother liquors are heated in known manner to form sodium carbonate, carbon dioxide and water and the carbon dioxide so formed is utilised as set out in the process of claim 7 to produce sodium bicarbonate.

9. A process for the manufacture of cellulose pulp by means of a soda process in which spent liquors are concentrated by evaporation and the concentrated liquors are incinerated in a fluidized bed incinerator to produce a granular sodium carbonate incinerator product contaminated by chlorides, sulphates and potassium compounds, the incinerator product being dissolved in water and causticized in known manner to form white liquor comprising essentially sodium hydroxide, which white liquor is re-used in the said soda process to provide a closed system, the improvement comprising:

treating the incinerator product with water to form a slurry, agitating the slurry so as to dissolve incinerator product with its contaminants and at the same time crystallize substantially pure sodium carbonate monohydrate leaving a major proportion of the contaminants in solution, separating the substantially pure sodium carbonate from the mother liquor containing the contaminants, and washing the separated sodium carbonate with water; and carbonating the mother liquor with a flue gas containing carbon dioxide, maintaining the liquor at a temperature of about 45° C. producing a precipitate consisting mainly of sodium sesquicarbonate, separating the precipitate from the mother liquor, and converting the precipitate to substantially pure sodium carbonate;

utilizing sodium carbonate recovered in the formation of white liquor; and discharging the contaminant bearing second mother liquor from the system.

* * * * *